United States Patent [19]

Richter et al.

[11] Patent Number: 5,021,039

[45] Date of Patent: Jun. 4, 1991

[54] APPARATUS FOR MANUFACTURING AIR CUSHION DISPATCH PACKAGES

[75] Inventors: Karl-Heinz Richter, Crailsheim; Hubert Kurz, Munich; Georg Kuecha, Feuchtwangen, all of Fed. Rep. of Germany

[73] Assignee: Vereinigte Papierwarenfabriken GmbH, Munich, Fed. Rep. of Germany

[21] Appl. No.: 438,980

[22] Filed: Nov. 20, 1989

Related U.S. Application Data

[63] Continuation of Ser. No. 37,308, Apr. 10, 1987, abandoned.

[30] Foreign Application Priority Data

Apr. 10, 1986 [DE] Fed. Rep. of Germany ..... 3612136

[51] Int. Cl.[5] ..... B31B 1/64

[52] U.S. Cl. ..... 493/14; 493/11; 493/20; 493/190; 493/196

[58] Field of Search ..... 493/11-14, 493/19, 20, 966, 967, 190, 196, 201, 209, 224, 381; 53/553; 156/145, 543, 553; 226/17

[56] References Cited

U.S. PATENT DOCUMENTS

| | | | |
|---|---|---|---|
| 2,737,764 | 3/1956 | Lewis | 53/553 |
| 3,112,055 | 11/1963 | Hartley | 156/553 |
| 3,283,671 | 11/1966 | Campbell | 493/196 |
| 3,368,726 | 2/1968 | Funk et al. | 226/17 |
| 3,397,508 | 8/1968 | Stroop | 493/224 |
| 3,817,803 | 6/1974 | Horsky | 156/145 |
| 3,853,664 | 12/1974 | LaFleur | 493/209 |
| 3,896,712 | 7/1975 | Ehlscheid . | |
| 3,983,794 | 10/1976 | Buchner | 493/190 |
| 4,016,806 | 4/1977 | Schuster | 493/209 |
| 4,169,344 | 10/1979 | Ganz et al. | 53/553 |

FOREIGN PATENT DOCUMENTS

| | | | |
|---|---|---|---|
| 938821 | 12/1973 | Canada | 493/209 |
| 2164152 | 9/1972 | Fed. Rep. of Germany . | |
| 2629679 | 12/1978 | Fed. Rep. of Germany . | |

OTHER PUBLICATIONS

Lytel, *Photoelectric Register Controls*, Ind. Electronics, Jan. 1960.

*Primary Examiner*—Frederick R. Schmidt
*Assistant Examiner*—Jack Lavinder
*Attorney, Agent, or Firm*—Nolte, Nolte and Hunter

[57] ABSTRACT

An apparatus for manufacturing air-cushion dispatch packages, the apparatus comprising an unwinding mechanism for paper webs and air-cushion foil webs. The apparatus introduces air-cushion foil webs between the paper webs and seals each paper web to a foil web over a large area. Transverse and longitudinal sealers seal the edges of the packages. After each sealing operation, the webs are subsequently cooled. Pulling rollers press the paper webs in the edge regions of the packages and advance the webs. Cutters cut the dispatch packages to the desired format. Web controllers correct deviation of the paper webs. A cycle controller is included.

14 Claims, 10 Drawing Sheets

APPARATUS FOR MANUFACTURING AIR CUSHION DISPATCH PACKAGES

This application is a continuation of U.S. Pat. application Ser. No. 07/037,308 filed, Apr. 10, 1987, now abandoned; which is based on a patent cooperation treaty appplication filed in the Federal Republic of Germany, No. P 36 12 136.3, filed Apr. 10, 1986.

BACKGROUND OF THE INVENTION

This invention concern an apparatus for manufacturing air-cushion dispatch packages.

Air-cushion dispatch packages are becoming increasingly popular for the mail order dispatch of products sensitive to pressure or susceptible to shocks, due to their cushioning effect and because of their relatively low weight. An apparatus for manufacturing them mechanically is alreay known which comprises two unwinding mechanism for coated sodium paper with the traction of the paper webs regulated by friction brakes. The unwinding mechanism also comprises a single web of air-cushion foil which is formed from a folded triangle to a semi-tupe and guided between the paper webs. This apparatus also comprises means for hot-sealing and subsequent cooling the paper webs with the web of air-cushion foil introduced therebetween, in the region of the edge of the dispatch package. Separate longitudinal and transverse sealing rails and corresponding cooling rails are provided. The paper webs with the sealed-in air-cushion foil are conveyed by means of a traction mechanism and the dispatch packages are cut to the desired format in longitudinal cutting means and transverse cutting means.

A disadvantage of the known apparatus in practical operation is that a relatively large amount of waste is produced during the manufacture of air-cushion dispatch packages. Among other things this is caused by tension arising during the sealing of the paper webs with the web of air-cushion foil and the resulting lateral divergence of the paper webs provided with the sealed-in web of air-cushion foil and the necessity of having to stop the machine to change the rolls of air-cushion foil. A further drawback is that it is not only relatively awkward but also time-consuming to change the format of the dispatch package to be manufactured. The known apparatus also causes traction marks on the dispatch qackage in the form of undesirable indentations with the danger that the air-cushion can become damaged. A still further drawback is that the sealing rails may be soiled and stuck from sealing which may cause the dispatch packages to become soiled as well. The manufacturing process has to be interrupted regularly to clean the sealing rails and this leads to production losses.

Specific apparatus for producing air-cushion mailing bags are referred to in DE-OS 2,629,679. This known apparatus comprises a paper unwinding means for a single paper web and an air-cushion sheet unwinding means for a single air-cushion sheet web, the air-cushion sheet web secured to the paper web by means of edge transverse sealing being folded over in a folding station to form a semihose.

A disadvantage with this known apparatus is that with it only a single mailing envelope or bag can be made in one working cycle and said bag does not have a relatively firm edge zone as lateral protection against impacts on all sides. Furthermore, in the known apparatus a relatively large number of rejects occur due to the occurrence of stresses in the sealing of the paper web to the air-cushion sheet web and the subsequent folding. Another disadvantage is that a format change in the mailing bag to be manufactured is relatively complicated and time-consuming.

DE-OS 2,164,152 refers to a protection container and a method for production thereof in the form of a mailing bag in which a lateral edge sealing is disclosed. However, due to the folding operation, production of mailing bags with a stable edge protection region all round is not possible.

U.S. Pat. No. 3,896,712 refers to an apparatus for the automatic production of envelopes which have a simple format adjustment by rotatable pinions which engage into a system with racks and spindles. There is no reference to the specific production of air-cushion mailing bags or envelopes and the problemes they involve.

At least some of the above-mentioned problems are to be solved by the invention.

SUMMARY OF THE INVENTION

It is therefore the object of the present invention to provide an apparatus for manufacturing air-cushion dispatch packages which is simple in terms of construction and which ensures rapid and reliable manufacture of air-cushion dispatch packages.

Another object of the present invention is to further develop an apparatus of the type set forth at the beginning in such a manner that, during one working cycle, mailing bags of different formats can be made with a minimum number of rejects.

In accordance with the invention this object is solved by the features outlined in claim 1. Preferred features, which advantageously further develop the invention, are the subject of subordinate claims.

Due to the inventive embodiment of the apparatus partial and/or complete surface sealing of webs of air-cushion foil to the paper webs can be carried out in the surface sealing means. This advantageously provides the connection of a larger surface of the webs of air-cushion foil to the paper webs and thus reduces mutual tensions. The inventive web control means advantageously enhances the rapid and reliable manufacture of the package without waste by providing effective correction of the paper webs united to the sealed-in webs of air-cushion foil upstream of the cutting mechanism. The provided cycle control for controlling the movement of the paper webs and the webs of air-cushion foil downstream of the sealing zone makes the technically complicated concept of having a sealing carriage, which moves in synchronism with the continuous web feed, superfluous, thus making it possible in a favourable way to simplify the construction of the apparatus so that it is reliable in sealing and subsequently cooling the paper webs with the webs of air-cushion foil introduced therebetween.

The apparatus is preferably embodied for the side-by-side manufacture of dispatch packages. This advantageously provides for the manufacture of an optimum number of air-cushion dispatch packages in terms of machine cost in a single operation. Manufacturing security is further enhanced by providing means, preferably a non-sticking element, such as PTFE lance, which is fixedly attached to the apparatus and which prevents the sealing of the package openings, in the region of the package openings, which are provided on the sides in the direction of transport of the paper webs, between the two webs of air-cushion foil for longitudinal sealing thereof. According to a preferred embodiment it is furthermore advantageous to provide an adjustable protection means for longitudinal sealing elements to protect them against soiling or adhesion for the purpose of longitudinally sealing the paper webs. This protection means preferably comprises an unwinding web of PTFE attached to the longitudinal sealing element.

An advantage of the present invention is that an apparatus is obtained for producing air-cushion mailing bags or envelopes in which two or more cushioned mailing bags can be made in one working cycle. The relatively strong edge zones of each mailing bag, which serves as lateral protection against impacts, serve to reduce rejects in the production. In addition, the sealing of the air-cushion sheet to the paper web plays a major part in the reduction of rejects and thus serves to improve the operational reliability of the apparatus claimed. The large-area sealing provided also permits, in favorable manner, reduction of stresses between the paper webs and the air-cushion sheets webs and thus likewise substantially contributes to operational reliability of the apparatus and reduction of the number of rejects. Due to the overall design, the production of different mailing bag formats is considerably simplified.

In a preferred embodiment example of the invention an adjusting means and portion length setting means are provided for adapting the apparatus to accomodate various dispatch package formats. This format adjustment means preferably comprises racks arranged in the direction of transport and crosswise to the direction of transport of the paper webs. The racks are in mesh with pinions mounted on sealing and cooling elements of the sealing and cooling means. The pinions are rotatable for the purpose of carrying out adjustments. It is also advantageous to provide measuring scales on both sides of the direction of transport of the paper webs at least for checking the setting of the transverse format. The measuring scales are fixedly attached to the apparatus. In a preferred embodiment of the invention the portion length setting means is provided in the form of a photoelectric cell control for determining the section for cross-cutting the dispatch packages.

With respect to reliable manufacture and low waste production it is furthermore advantageous to provide traction rollers for conveying the paper webs sealed to the foil webs. These traction rollers engage a longitudinal sealing seam provided in the middle of the paper web and the lateral edges of the paper webs, in each case at a longitudinal sealing seam provided in the region of the package openings. In this way the traction rollers always have a smooth engagement surface.

The transport of the paper web sealed to the air-cushion sheet webs is preferably by means of pulling rollers which engage on a longitudinal seal seam made within the paper web and the lateral edges of the paper web, the web run control preferably comprising in the edge region of the sealed paper web in each case a driveless guide roller outwardly inclined in the paper web running direction and an associated driveless pressure roller outwardly inclined in the paper web running direction, the pressure roller engaging the other opposite edge of the paper web only when the paper web runs out and the application duration of the pressure roller being adustable by a timing member.

To determine any incorrect running of the paper web advantageously a photocell is also provided at each edge and the signal of said cell can activate the application of the pressure roller provided for the other opposite edge via an electrically controlled compressed air cylinder.

According to a further embodiment of the invention, the apparatus comprises paper printing means which are provided upstream of the surface sealing means in the direction of transport of the paper webs. This means makes it favourably possible to print at least one of the paper webs during the manufacturing cycle. Exact register control is favourably provided by means of a system of photoelectric cells, and in printing it is advantageously possible to attach printed marks on the paper webs which can be used for the photo-electric control of the section or portion lengths of the dispatch packages.

According to a still further embodiment of the inventive means punching means are arranged upstream of the web control means in the direction of transport of the paper webs for the purpose of punching flap holes and for skewing the flaps. The punching means also preferably comprises adjusting means which include racks, pinions in mesh therewith and operable for the purpose of carrying out adjustments, and a measuring scale. This is advantageous not only for simple and fast format changes, it also makes it possible for example to set the position of the flap holes to meet individual requirements.

Accordingly to a still further embodiment of the inventive means the lateral application of fixing flap webs is provided for on the lower paper web upstream of the surfaces sealing means. It is furthermore advantageous to arrange two double unwinding mechanisms for the air-cushion foils upstream of the surface sealing means, providing each double unwinding mechanism with automatic end-to-end bonding means. In this way machine standstill is avoided when changing the rolls, which effectively enhances the fast and reliable manufacture of air-cushion dispatch packages.

BRIEF DESCRIPTION OF THE DRAWINGS

Further details, features and advantages of the invention will become readily apparent from reading the following part of the specification which describes one embodiment example of the invention in greater detail with reference to the accompanying drawing, in which.

DETAILED DESCRIPTION OF THE PREFERRED EMBODIMENT

Figure 1:
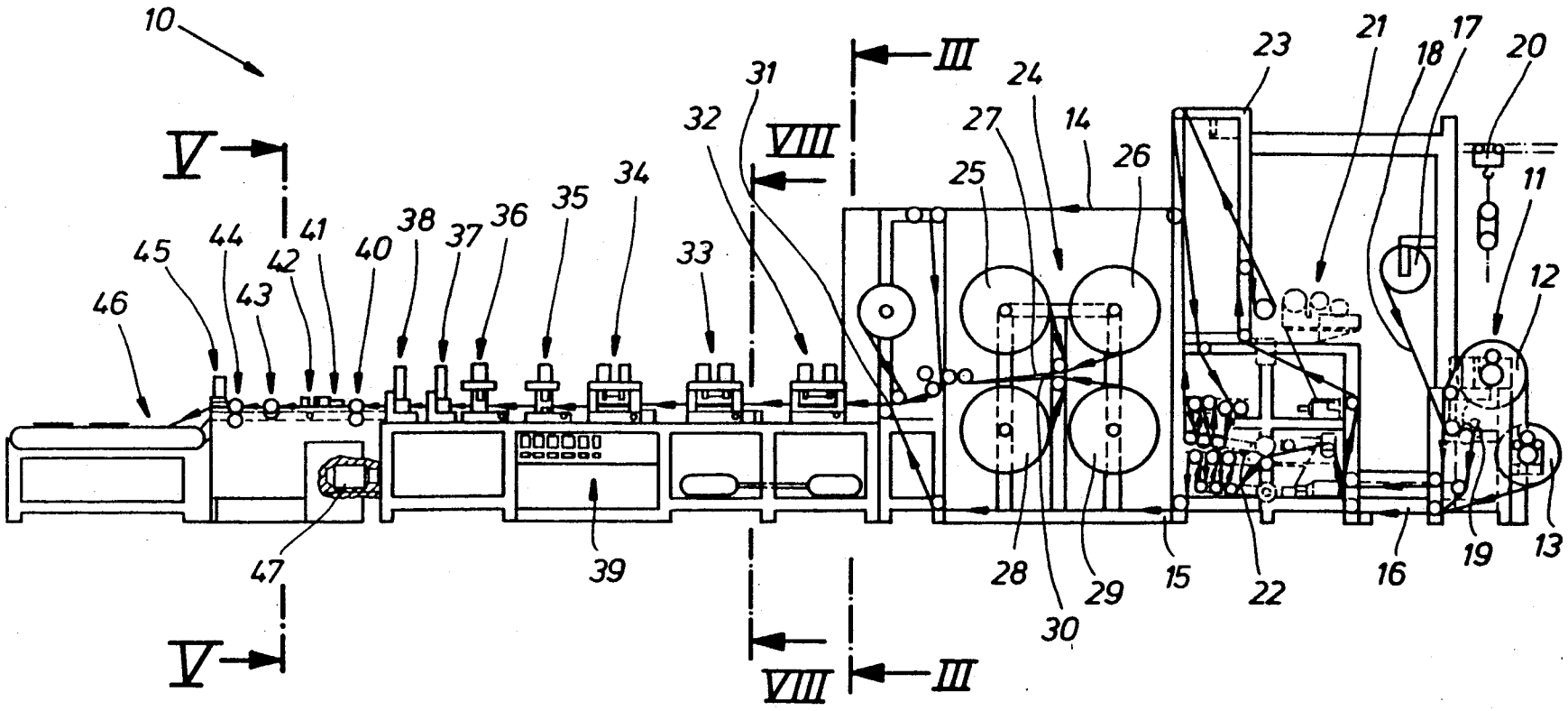
FIG. 1 is a side view of an apparatus for manufacturing air-cushion dispatch packages.
Figure 2:
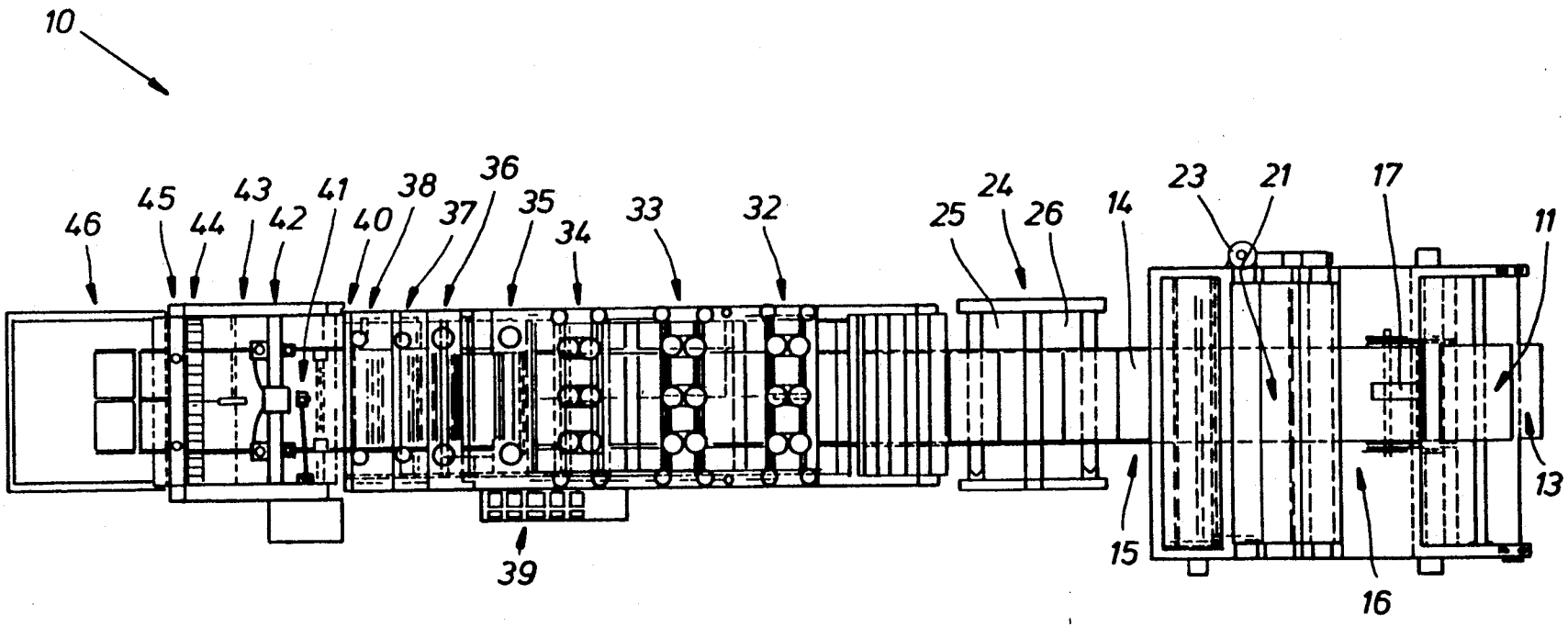
FIG. 2 is a top view of the apparatus according to FIG. 1.

Referring first to FIGS. 1 and 2 an embodiment example of an apparatus 10 is shown which is used for manufacturing air-cushion dispatch packages. The air-cushion dispatch packages are assembled from paper webs and webs of air-cushion foil in the apparatus 10 and are manufactured by a plurality of means linked up in conveyor means.

The illustration in FIGS. 1 and 2 have been partially schematised to provide a better understanding of the construction and manner of operation of the inventive means. Viewed in the direction of feed, the means 10 first comprises unwinding means 11 including two paper rollers 12 and 13, paper roller 12 feeding the upper paper web 14 for the dispatch packages to be manufactured and paper roller 13 feeding the lower paper web 15 for the dispatch packages to be manufactured. The paper is coated and may comprise, by way of example, sodium paper. The upper paper web 14 and the lower paper web 15 are guided through a system of deflection rollers arranged in the frame 16.

Two further rollers 17 are arranged in the unwinding means 11, each of which comprises a fixing flap tape which is guided to means 19 for in-line manufacture of the fixing seal. A crane 20 with lever equipment is provided above the paper rollers 12 and 13 for exchanging the paper rolls, which have a diameter of about 800 mm, and for exchanging the pneumatic jacks for paper printing means indicated by numeral 21. The paper printing means 21 preferably comprises a reflex printing unit having a width of approximately 1,270 mm.

The upper paper web 14 passes continuously through the paper printing means 21 and is then conveyed continuously from the upper half of paper web tractor 22. The lower half of these paper web tractor 22 is provided for continuous movement of the lower paper web 13. The paper printing means is arranged together with a drive (not shown) in a printing unit stand 23 which is fixedly connected to the frame 16 of the unwinding means 11 and to the guide rail for the crane and the lever equipment 20.

Continuing in the direction of feed of the paper webs 14 and 15, this is followed by unwinding means 24 for the rolls of air-cushion foil in which two double unwinding means are provided with a total of four rollers. Machine standstill is avoided during the exchange of the rolls by providing such double unwinding means. The double unwinding means 24 is additionally provided with an automatic gluing station (not shown) in which the end of the one web air-cushion foil of a roll can be united end-to-end with the beginning of web of air-cushion foil from the next roll. The rollers 25 and 26 are provided for alternative supply of the upper web of air-cushion foil 27, whereas the lower rolls 28 and 29 are provided for alternative supply of the lower web of air-cushion foil 30.

The apparatus 10 is equipped for the side-by-side manufacture of dispatch packages. For this purpose the upper web of air-cushion foil 27 and the lower web of air-cushion foil 30 are introduced between the upper paper web 14 and the lower paper web 15. The lower paper web 15 protrudes beyond each side of the upper paper web 14 in an amount corresponding to the width of the flaps. The fixing tape is rolled off along this projecting portion of the lower paper web 15 by means of apparatus indicated by numeral 31. The means 31 is also fixedly connected as a unit to the frame 16.

After both webs of air-cushion foil 27 and 30 have been introduced into the two paper webs 14 and 15 they pass on into a surface sealing means 32 where they are partially and/or fully surface-sealed to the paper. Details of this surface sealing means will be described hereinafter with reference to FIG. 3 and FIG. 4. The frame of this surface sealing means 32 is fixedly connected as a unit to the frame 16.

Downstream of the surface sealing means 32 is provided a longitudinal sealing means 33 in which, in accordance with the selected format of the dispatch packages, hot sealing is performed between the two paper webs in the direction of feed thereof. Details of this longitudinal sealing means will be described hereinafter with reference to FIG. 8 and FIG. 9. The longitudinal sealing means 33 also includes a frame which is fixedly connected to the frame of the other devices.

Provided further downstream is a longitudinal cooling means 34 in which at least the sealing seam in the middle of the paper web, which is still hot, is cooled. Still further downstream are transverse sealing means 35 in which sealing seams are made crosswise with respect to the paper web in accordance with the set format size of the dispatch packages. These hot transverse sealing seams are cooled still further downstream in cooling means 36. Holes are punched in the flaps and the latter are skewed in punching means 37, 38 provided still further downstream. The means 34 to 38 are also mounted in a frame which is fixedly attached to the frame 16. Triggering means 39 for driving and synchronising the pulsed feed of the webs with the operation of the individual means are provided below the longitudinal cooling means 34 and the transverse sealing means 35.

Reference numeral 40 indicates a traction roller assembly, each such assembly comprisng three rollers which engage in the region of the middle sealing seam and in the region of the dispatch package flaps. This is followed downstream by a photoelectric cell for determining the sections of the dispatch packages to be cut. Further downstream thereof are web control means 42. Details of the photoelectric cell control for determining the sections and the web control means will be described hereinafter with reference to FIGS. 5 to 7. The aforesaid means are all mounted on a frame which is connected to the frame 16 to form a single unit.

Numeral 43 indicates a circular cutter which is used for separating the sealed paper webs in the middle. A further tractor is provided at 44. Similar to the tractor 40, this tractor is also embodied with cylinders which have raised rollers for engaging both sides of the welded paper webs in the region of the sealing seams. Numeral 45 denotes transverse cutting means which cross-cuts along the transverse seam, controlled by the section control of the photoelectric cell control means 41. Finally, at the end of the apparatus a depositing table 46 is provided on which the finished air-cushion dispatch packages are deposited after leaving the apparatus. The frame of this table is also united to the remaining frame of the apparatus, forming a single unit.

For the sake of simplicity, only an electric motor 47 is illustrated below the traction means 40; it stands for the whole of the driving means of the apparatus 10. The sealing, coolind and punching means are driven by means of pneumatic jacks which are pressurised at a pace which is determined by the selected format size and the feed velocity and also by the temperature provided at the sealing elements. This means can manufacture formats in the range of from 100 to 500 mm at a working width of 1,100 mm without having to change the tools. For this purpose a simple adjusting means is provided for the respective means. The sealing and cooling means and the punching means can be adjusted thereby via a crank operating together with racks fixedly mounted on the frame. In order to be able to set a format to the last millimeter in the shortest possible time, a measuring scale or calibration is arranged along the whole of the lengths of the connecting members on both sides of the sealing means. A driving crank-and-rocker mechanism in a driving machine is adjusted for setting the section length. It is possible to set the format length anywhere betwen 100 and 500 mm. The operation speed of a prototype of the apparatus amounted to about 40 operating cycles per minute. Due to the apparatus being equipped for side-by-side manufacture this corresponds to an output of 80 dispatch packages per minute.

In the prototype the temperature for longitudinal sealing of the middle seam and for transverse sealing amounted to approximately 250° C., a temperature of about 230° C. being selected as sealing temperature in the region of the sealing flaps. The respectively applicable temperatures can be adjusted dependent on the quality of the material and the operating speed for maximum efficiency with minimum heating energy requirements.

In the prototype that was constructed the sealing mechanism was activated by means of a cam wheel. The setting of the desired formats for the dispatch packages is not only extremely simple in terms of the construction of the machine due to the adjusting mechanism provided thereon, but it is also simple to operate. Fixed format marks facilitate the setting of fixed formats.

Figure 3:
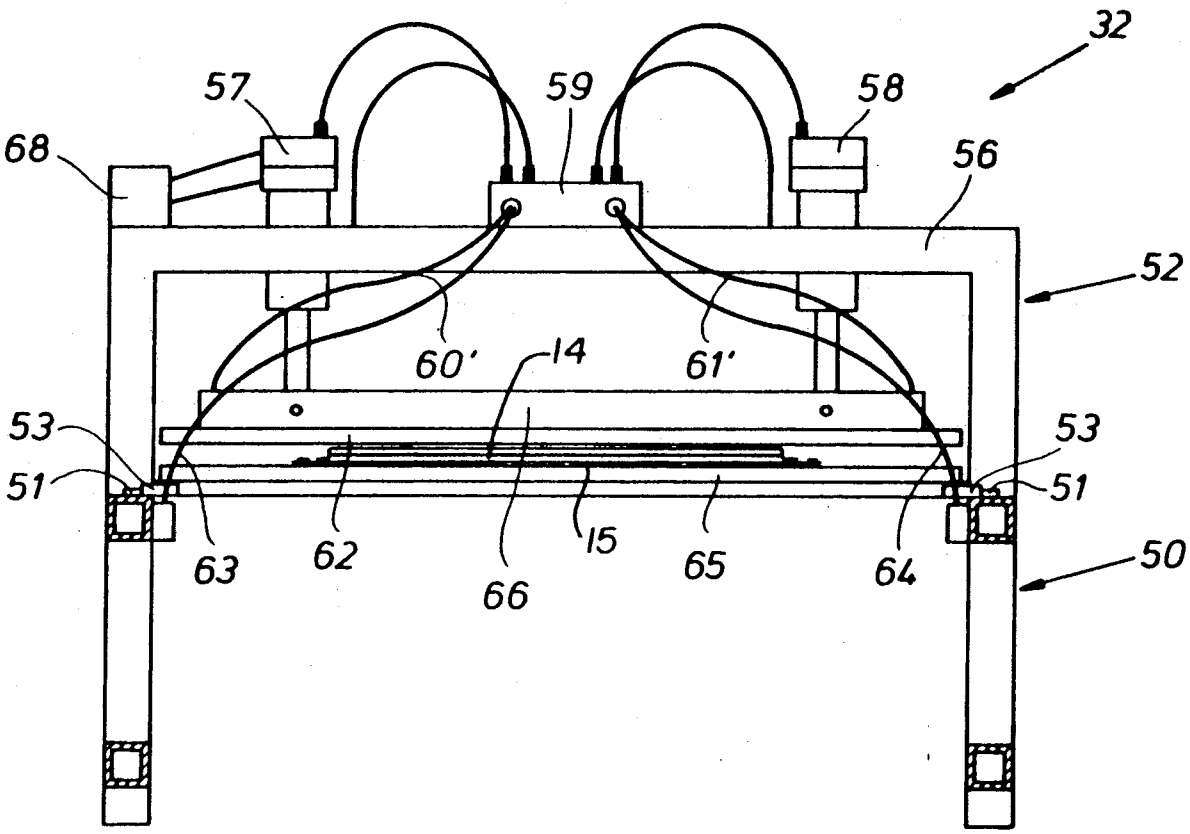
FIG. 3 is a sectional view along the line III—III in FIG. 1.
Figure 4:
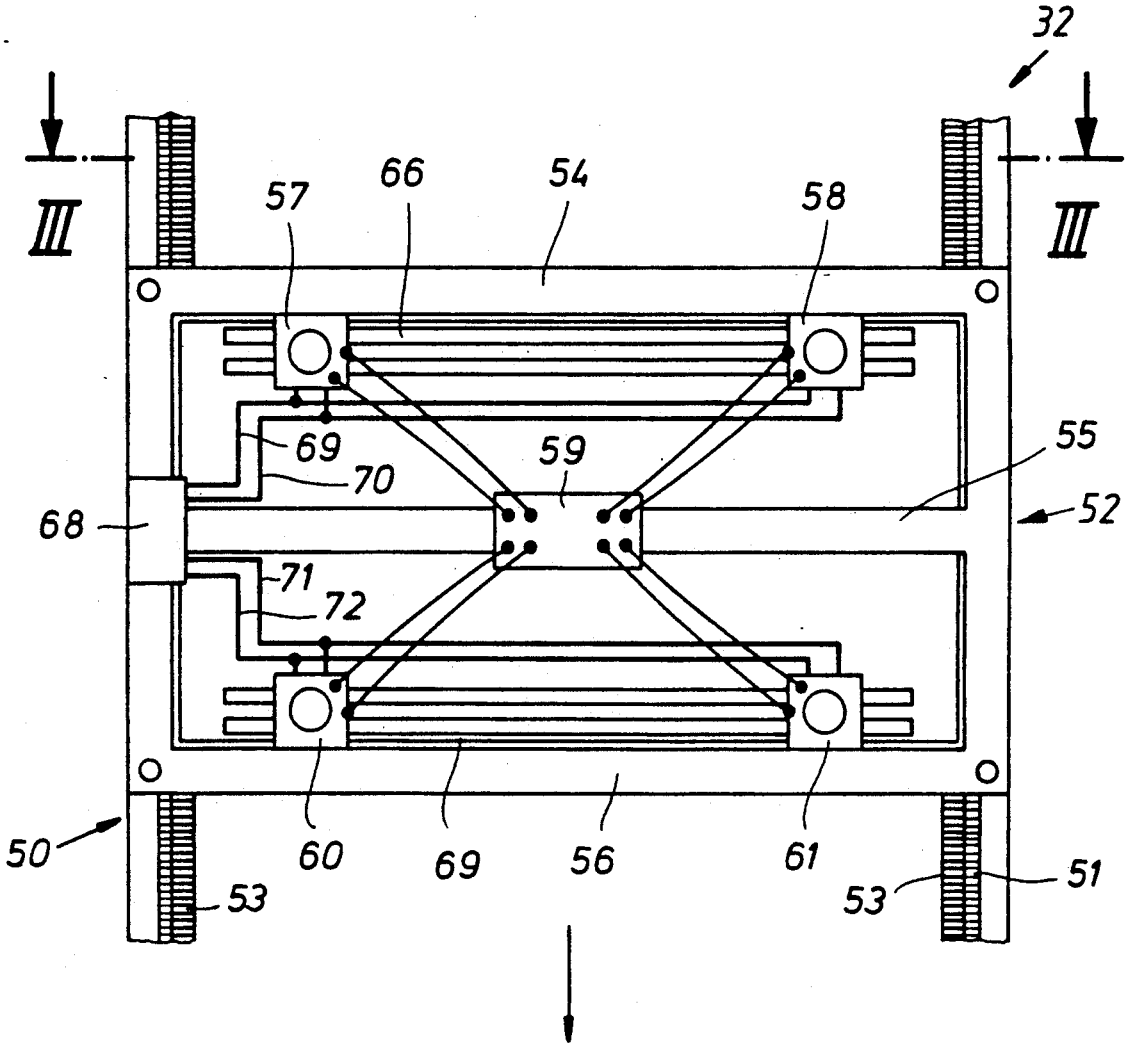
FIG. 4 is a top view of the surface sealing means shown in FIG. 3.

The area surface sealing means 32 is shown in the direction of feed in FIG. 3, and a top view of it is shown in FIG. 4. A carriage 52 is provided on tracks 51 on a frame 50 which is fixedly integrated in the frame of the apparatus 10. The carriage 52 can be fixed at a given position on the tracks by means of fastening screws. This position can be set by means of adjusting means (not shown) which are in mesh with the racks 53 indicated in FIG. 4.

As can be seen in FIG. 3, area sealing means 32 applies by sealing plates 62, 65, an area seal across webs 14, 15 for partial and/or complete surface sealing of the paper webs to the air-cushion material.

The carriage 52 includes three transverse profiles 54 to 56. Two pneumatic jacks 57 and 58 are mounted on the transverse profiles 54. The transverse profile carries a distributor 59 from where electric heating leads 60' and 61' lead to an upper sealing plate 62 and electric heating leads 63 and 64 lead to a lower sealing plate 65. Again for the sake of simplicity, the heating leads 63 and 64 are illustrated below the carriage 52 only.

The direction of transport of the paper webs is indicated by an arrow in FIG. 4. The piston rods of the pneumatic jacks 57, 58, 60 and 61 are linked to double transverse profile 66 and 67 respectively, extending crosswise with respect to the sealing plate 62. The upper sealing plate 62 can be urged against the lower sealing plate 65 by means of the pneumatic jacks 57, 58, 60 and 61. The lower sealing plate 65 is fixedly connected to the carriage 52. The compressed-air valves 57, 58, 60 and 61 are activated via control valve means 68 communicating with the compressed-air cylinder via pneumatic tubes 69 to 72.

The upper sealing plate 62 and the lower sealing plate 65 are approximately the same size and rectangular in shape. Their temperature is controlled by means of a thermostat and can be adjusted.

Figure 5:
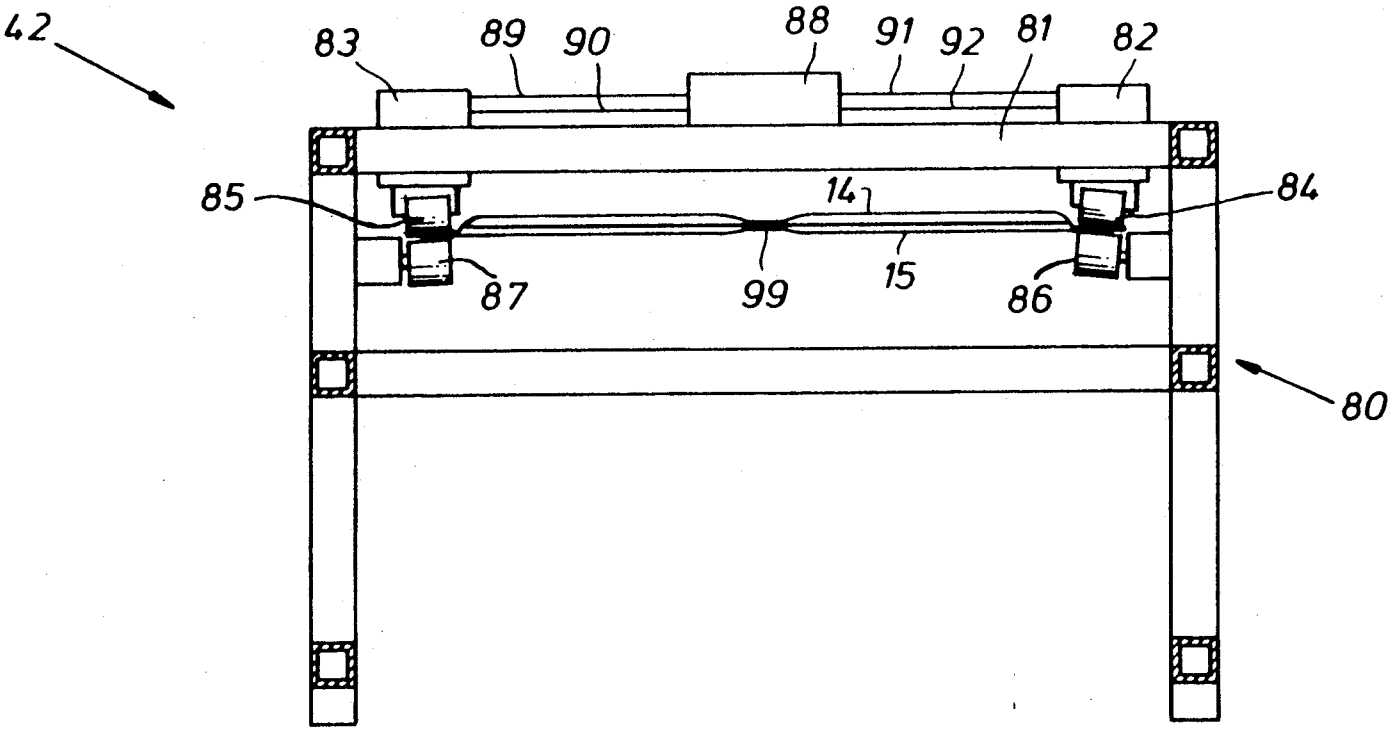
FIG. 5 is a sectional view along the line V—V in FIG. 1 illustrating the web control means.
Figure 6:
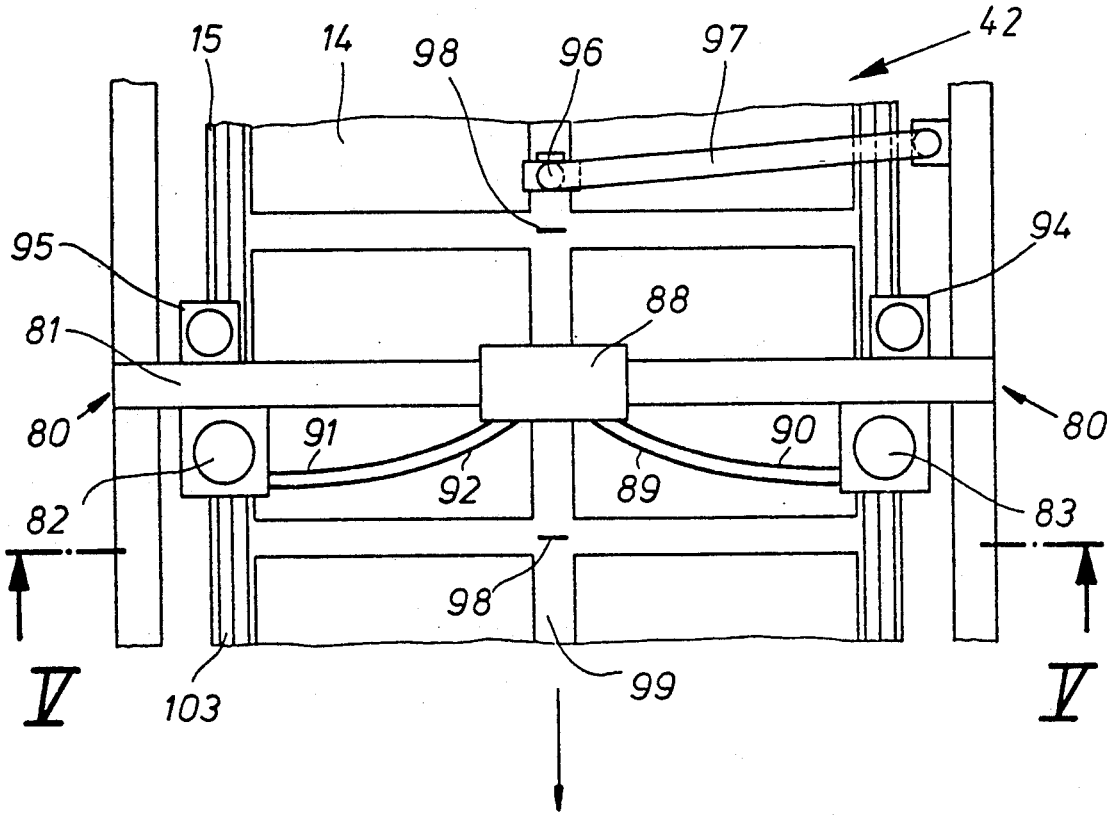
FIG. 6 is a top view of the web control means according to FIG. 5.
Figure 7:
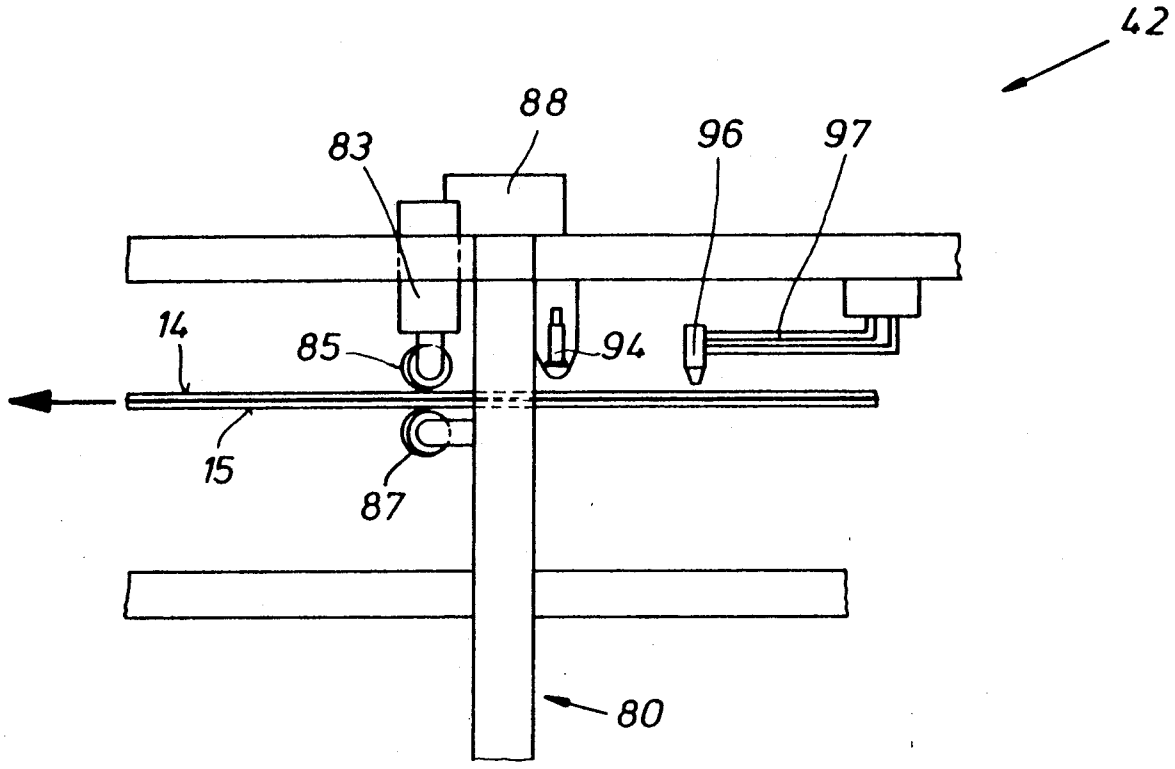
FIG. 7 is a side view of the web control means according to FIG. 5.

The web control means 42 is shown schematically in FIGS. 5 to 7. Pneumatic jacks 82 and 83 are mounted on a transverse profile 81 attached to a basic frame 80 which is fixedly connected to the remaining frame of the apparatus 10. The piston of the pneumatic jack 82 is connected to the axle of a pressing roller 84. The pressing rollers 84 is cocked outwardly in the direction of transport of the paper webs. Similarly, the pneumatic jack 83 is connected to the driving shaft of a pressing roller 85 which is also cocked outwardly in the direction of transport of the paper webs. The pressing rollers 84 and 85 can be pressed downwardly and brought into contact with the lower paper web in the region of the outer edge thereof by means of the pneumatic jacks 82 and 83 respectively. This region of contact of the paper web rests on guides rolls 86 and 87 which are fixedly attached to the apparatus and which are also cocked in accordance with the respective traction rollers associated therewith. A control valve 88 is provided for activating the compressed-air valves 82 and 83 respectively. The control valve 88 communicates via pneumatic tubes 89 and 90 with the pneumatic jack 83 and via pneumatic tubes 91 and 92 with the penumatic jack 82.

As is apparent from FIGS. 6 and 7, in which the direction of transport of the paper webs is indicated by an arrow, photoelectric cells 94 and 95, which scan the edges of the paper web, are provided on the transverse profile 81 arranged above the edge region of paper web. The photoelectric cells 94 and 95 are shown schematically in the drawing. They are connected electrically to the control valve 88 in a manner which is not illustrated. When the paper web deviates to one side, e.g. to the right of the direction of transport as shown in FIG. 6, the photoelectric cell transmits a signal to a relay by means of which the pneumatic jack 83 is activated via the control valve 88 which is embodied as a solenoid valve. In this way the pressing roller 85, which, like the pressing roller 84, was originally in a spaced relationship with the guide roller 87 (or 86 respectively) associated therewith, is urged into contact with edge of the paper web, and the traction roller is capable by virtue of its cocked position to pull the web towards it until the photoelectric cell 95 to longer determines any deviation or slippage of the paper web. Similarly, the photoelectric cell 94 operates together with the pneumatic jack 82 arranged on the opposite side of the paper web to take corrective action on that side. The length of time the pressing rollers 84 and 85 respectively are in contact with the paper web can be determined either by means of the course signal transmitted from the opposite photoelectric cell or by means of a time lag relay. Furthermore, the cocked postion of the traction means comprising traction roller and guide roller can be advantageously varied for adaption to respective operating conditions.

The web control means 42 can be universally applied to the control of moving web materials which tend to slip or deviate from the straight direction of transport, particularly in the range of ±10 mm. In this case the direction of transport can be kept constant within a tolerance of ±1 mm.

Figure 10:
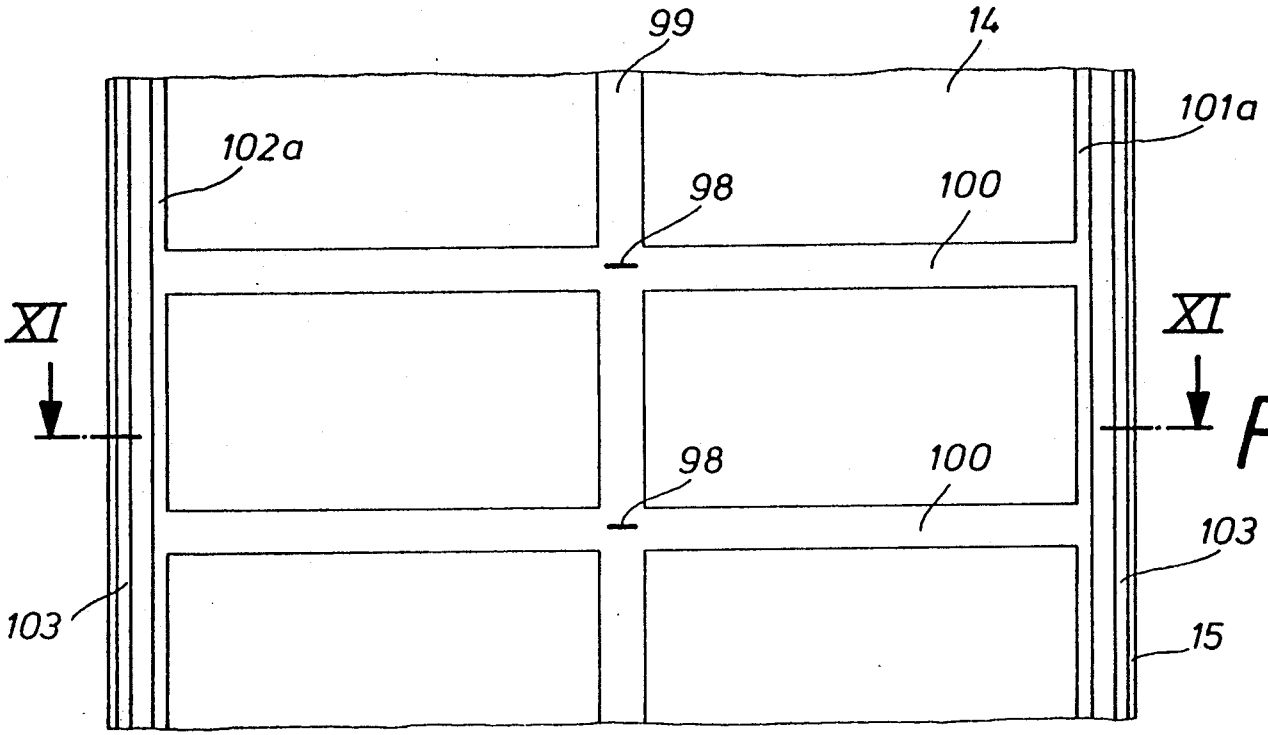
FIG. 10 is a top view of a section of the sealed uncut paper webs.

Further referring to FIG. 6, a photoelectric cell control is provided which comprises a photoelectric cell control 96 arranged above the paper web in the mid-portion thereof. A cut length setting means comprises photoelectric cell 96 and swivelling arm 97. The photoelectric cell 96 can be adjusted by means of a swivelling arm 97, by means of which it is also mounted on the frame 80. The photocell control 96 reacts to a transverse mark 98 in the region of the middle sealing seam 99 of the upper paper web 14 to thereby effect exact control of the cross-cutting means 45. The appearance of the paper webs in this region is shown more clearly in FIGS. 10 and 11. The upper paper web 14 running above the upper web of air-cushion foil and lower web of air-cushion foil 30 is connected to the lower paper web 15 in the longitudinal seam 99 and in the transverse direction by means of transverse seams 100. Longitudinal seams 101*a*, 101*b*, 102*a* provided in the edge regions only unite the upper paper web 14 with the upper web of air-cushion foil 27 and the lower power web 15 with the lower web of air-cushion foil 30 so that the opening of the dispatch package remains open. Fixing flap tapes 103 (or 18) applied by the unwinding means (for the fixed tape) 31 are (mounted) fixed on the sections of the lower paper web 15 projecting to both sides beyond the upper paper web 14 these sections being (which are) provided for the (sealing) fixing flaps.

Figure 8:
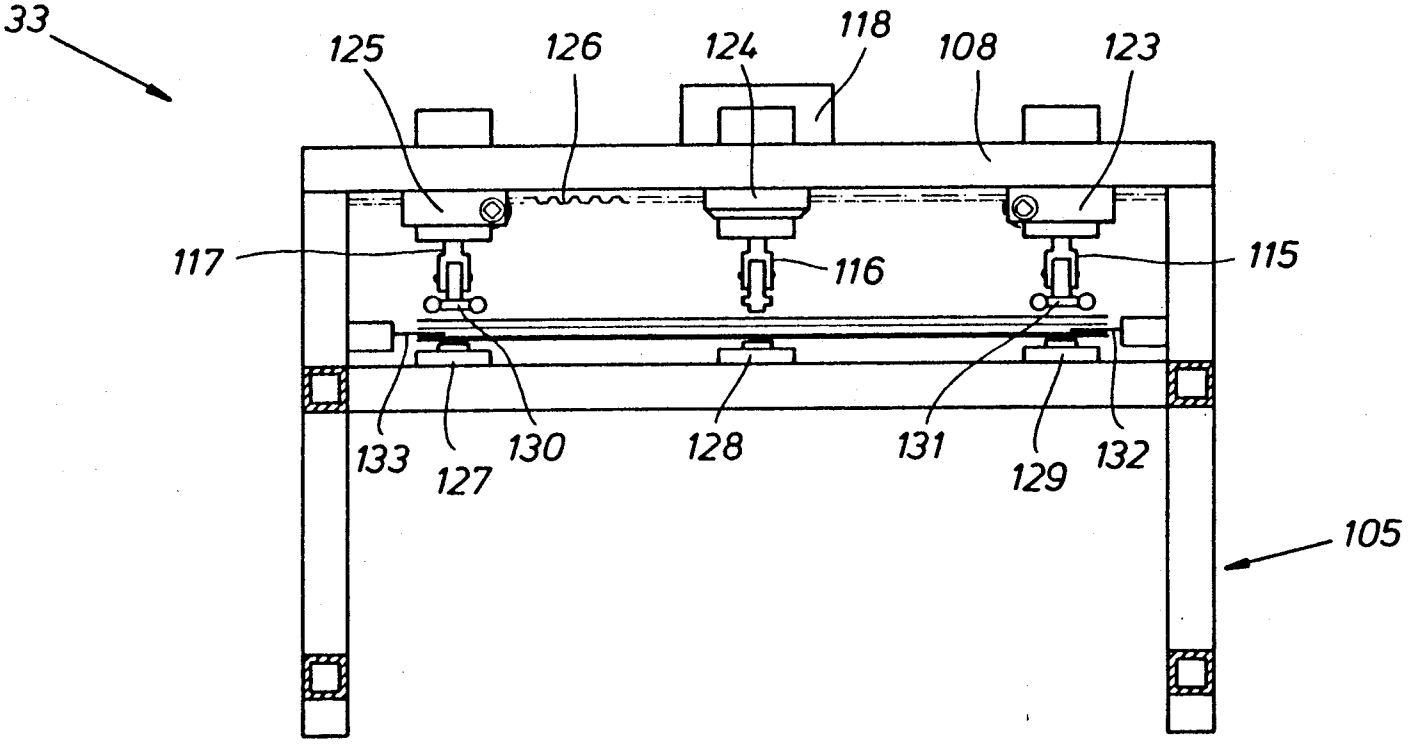
FIG. 8 is a sectional view along the line VIII—VIII in FIG. 1 illustrating the longitudinal sealing means.
Figure 9:
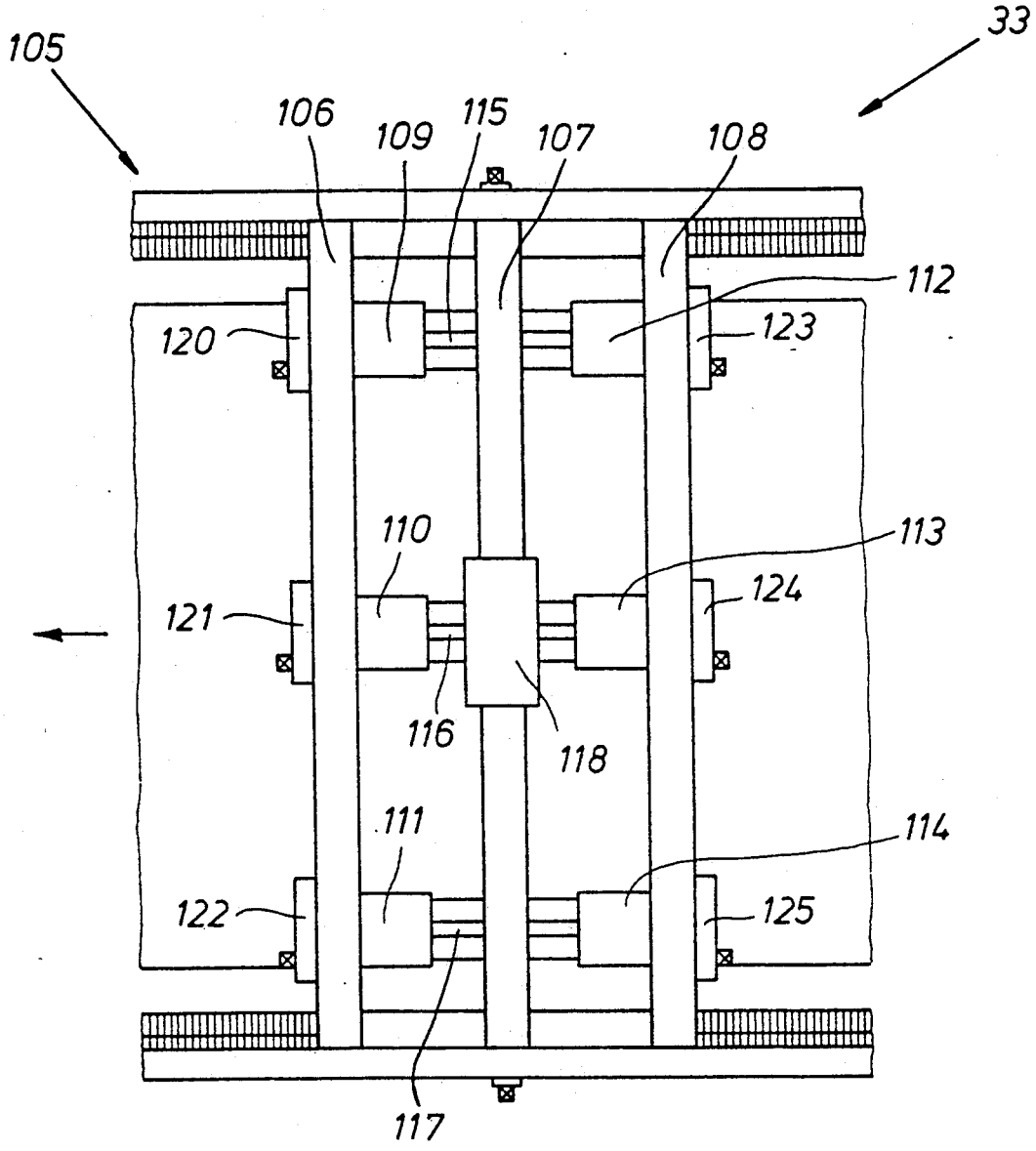
FIG. 9 is a top view of the longitudinal sealing means shown in FIG. 8.

For the sake of illustration, the longitudinal sealing means 33 is shown schematically in FIGS. 8 and 9. The longitudinal sealing means 33 comprises a frame 105 with three transverse profiles 106, 107 and 108. The frame 105 is fixedly connected to the remaining frame of the apparatus 10. Pneumatic jacks 109, 110, 111, and 112, 113, 114 are attached to the transverse profiles 106 and 108 respectively. The piston rods of the pneumatic jacks 109. and 112 are linked to a lateral sealing rail 115, the piston rods of the pneumatic jacks 110 and 113 are linked to a longitudinal sealing rail arranged in the middle of the web and the piston rods of the pneumatic jacks 111 and 114 are linked to a longitudinal sealing rail 117 arranged in the other edge zone. The mutual activation of the pneumatic jacks is effected by means of a central pneumatic control unit 118 via tube connections (not shown) so as to be in keeping with the pulses of the machine. The control unit 118 is attached to the transverse profile 107.

Adjusting means 120, 121 and 122, which communicate with the pneumatic jacks 109, 110, 111, are shown schematically on the outward side of the transverse profile 106 in the direction of transport. Similarly, adjusting means 123, 124 and 125 communicating with the pneumatic jacks 112, 113 and 114 are shown schematically on the outward side of the transverse profile 108. All of the pneumatic jacks are slidably arranged on the transverse profiles 106 and 108 respectively and can be adjust transversely with respect to the transport direction of the web indicated by an arrow in FIG. 9, by means of setting means for mailing bag formats, i.e. the adjusting means 120 to 125. A rack 126 is indicated in FIG. 8 at the bottom side of the transverse profile 108 with which pinions (not shown) of the setting means 121 to 125 engage for the purpose of adjusting the profiles.

Stationary sealing rails 127, 128 and 129 are associated with the sealing rails 115, 116 and 117. The stationary sealing rails 127–129 are provided with temperature adjustment, the same as the sealing rails 115–117. A thermostat control is provided for the temperature. An adjustable protection means is provided in the region of the sealing surface of the sealing rails 115 and 117. This protection means comprises webs of PTFE 130 and 131 which can be unwound on each side of the sealing elements on longitudinal rollers. This protection means effectively protects the longitudinal sealing surfaces of the longitudinal sealing elements 115 and 117 from becoming soiled to thereby prevent improper adhesion and damage in the region of the package openings. If the contact surface becomes soiled the PTFE web wound on a longitudinal roller only needs to be wound further onto the opposite longitudinal roller, thus making a new portion available for the longitudinal sealing elements. Since there is no danger of soiling occurring through melted foil emerging in the region of the longitudinal sealing element 116 arranged in the middle, no such protection means is provided on this longitudinal sealing rail.

Figure 11:
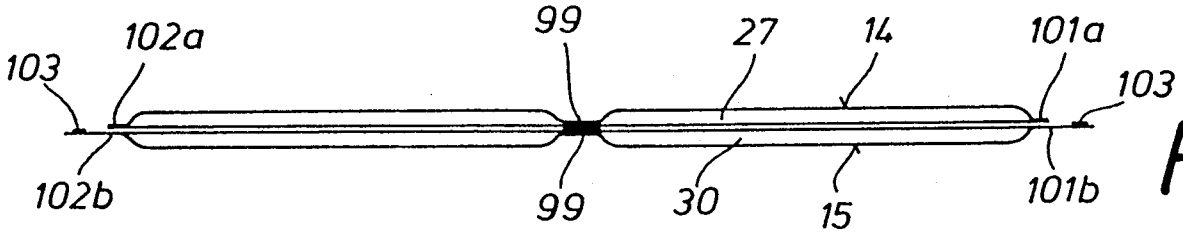
FIG. 11 is a sectional view along the line XI—XI in FIG. 10.

In order to prevent the adhesion of the longitudinal seam 101*a*, 101*b* and 102*a*, 102*b* shown in FIG. 11 in the region of the openings of the packages, means preventing such adhesion are provided on both sides of the paper webs on the frame 105. As indicated in FIG. 8, this means comprises an intermediate layer of PTFE which is embodied in the form of what is known as a PTFE lance and which becomes effective beside the longitudinal sealing elements 115 and 117, respectively.

Similar to the individual sealing rails, the cooling rails are also adjustable with respect to temperatures, contact pressure and the length of time they are in contact with the paper webs. A thermostat is also provided in the seam cooling means for the purpose of maintaining the desired cooling temperature.

The apparatus 10 operates with an adjustable cycle in a manufacturing line and the upper paper web 14 and lower paper web 15 pass from the unwinding means 11 through the various units, described with reference to FIG. 1, one after the other, whereby the air-cushion dispatch packages are manufactured. With the inventive concept short change-over time can be realised on an apparatus accomodating side-by-side manufacture of the packages. The apparatus is almost completely insusceptible to disruption and breakdown because the individual units are simple constructed. For its operation, the apparatus requires semi-skilled workers only. There are not problems as regards conveyance or sealing tracks on the packages or the like, whereby loss due to waste is minimised. The tension occuring during sealing of the combined paper webs and webs of air-cushion foil are dealt with without any problem. According to the inventive concept cooling rails or sealing rails do not need to be exchanged when varying the format because the desired format size can be set simply and reliably by shifting the element determining the format.

What is claimed is:

1. Apparatus for producing air-cushion mailing bags, said bags comprising an air-cushion sheet and paper, said sheet and paper facing each other over an area of their surfaces, said apparatus comprising:

a paper unwinding means for unwinding two separate paper webs;

air-cushion sheet unwinding means for unwinding two separate air-cushion sheet webs between the paper webs and in registration thereto;

each of said webs having a pair of longitudinal outer edges;

area sealing means disposed in a downstream direction from the unwinding means for sealing at least part of the area of the two paper webs brought together to the two air-cushion sheet webs introduced between said paper webs, and for holding said paper and air-cushion webs in registration to each other during subsequent production steps;

at least one longitudinal sealing means and one transverse sealing means for sealing an edge region of each mailing bag being produced, said transverse and longitudinal sealing means comprising means for defining a pair of transversely adjacent mailing bags there being at least three longitudinal sealing means in the apparatus;

said longitudinal sealing means comprising means for joining an upper paper web to an upper air-cushion web and a lower paper web to a lower air-cushion web at each outer web edge and means for longitudinally joining the upper and lower webs at the center of the webs;

means for cooperating with said longitudinal sealing means and for preventing joining of the upper webs to the lower webs at the outer web edges and thereby defining a pair of pocket openings in the bags, one opening at each of the outer web edges;

said longitudinal and transverse sealing means disposed downstream of the area sealing means;

a traction means for transporting the paper sealed to the air-cushion sheet, said traction means disposed downstream of the transverse and longitudinal sealing means;

means for cutting the mailing bags to an intended format, said cutting means disposed downstream of the traction means, and triggering means for actuating the sealing and cutting means to define a bag format.

2. Apparatus according to claim 1, having a web run control means for correcting any incorrect running of the two connected paper webs disposed upstream of the cutting means.

3. Apparatus according to claim 2, wherein the web run control means comprises:

in the edge region of the sealed paper web in each case, a driveless guide roller inclined outwardly in the downstream direction and an associated driveless pressure roller outwardly inclined in the downstream direction, the pressure roller engaging an other opposite edge of the paper web only when the paper web runs out; and timing means for adjusting the pressure duration of the pressure roller.

4. Apparatus according to claim 3, having:

photocell means for determining an incorrect running of the paper web at each edge, and for providing signal means for the application of the pressure roller, provided for the other opposite edge; and electrically controlled compressed air cylinder means for activating the pressure roller.

5. Apparatus according to claim 2, having in the running direction of the paper webs before the web run control means, a punching means for producing flap closure holes and for bevelling the closure flaps, said means comprising:

racks, and pinions meshing therewith and actuatable for adjustment.

6. Apparatus according to claim 1, wherein cooling means follow each of the longitudinal and transverse sealing means.

7. Apparatus according to claim 1, having in a region of pocket openings, provided in the running direction of the paper webs on the edge side, PTFE lance means between the two air cushion sheet webs during longitudinal sealing, said lance means for preventing a sealing of the pocket openings.

8. Apparatus according to claim 1, having adjustable coilable PTFE web means in the longitudinal sealing of the paper webs, for each longitudinal sealing means, said PTFE web means secured to its respective longitudinal sealing element and extending over an area to be sealed for preventing soiling or sticking.

9. Apparatus according to claim 1, in which a cut length setting means and a setting means for mailing bag formats are provided, the format setting means having racks in the running direction and transversely of the running direction of the paper webs and the racks meshing with adjusting pinions mounted on sealing elements of the sealing means and cooling elements of the cooling means.

10. Apparatus according to claim 1, wherein, for the transverse cutting of the mailing bags, a photocell control is provided for defining the cut.

11. Apparatus according to claim 1, wherein, for the transport of the paper webs sealed to the air cushion sheet webs, pulling rollers are provided which engage on a longitudinal seal seam made within the paper web and on the lateral edges of the paper web.

12. Apparatus for producing air-cushion mailing bags, said bags comprising an air-cushion sheet and paper, said bags having relatively strong side areas, said sheet and paper facing each other over an area of their surfaces, said apparatus comprising:

a paper unwinding means for unwinding two separate paper webs;

air-cushion sheet unwinding means for unwinding two separate air-cushion sheet webs;

area sealing means disposed in a downstream direction from the unwinding means for sealing at least part of the area of the two paper webs brought together to the two air-cushion sheet webs introduced between said paper webs, said webs being free of longitudinal folds;

three longitudinal sealing means and one transverse sealing means for sealing an edge region of each mailing bag being produced, including:

a central longitudinal sealing means for longitudinally sealing the center of the webs together to form a closed bag end with pockets on each side of the center seal; and outer edge longitudinal sealing means at each of two outer edges for sealing paper webs to air-cushion sheet webs without sealing the pocket openings;

said longitudinal and transverse sealing means disposed downstream of the area sealing means;

a traction means for transporting the paper sealed to the air-cushion sheet, said traction means disposed downstream of the transverse and longitudinal sealing means;

means for cutting the mailing bags to an intended format, said cutting means disposed downstream of the traction means; and triggering means for actuating aforementioned steps.

13. Apparatus for producing air-cushion mailing bags, said bags comprising an air-cushion sheet and paper, said bags having relatively strong side areas, said sheet and paper facing each other over an area of their surfaces, said apparatus comprising:

a paper unwinding means for unwinding two separate paper webs;

air-cushion sheet unwinding means for unwinding two separate air-cushion sheet webs;

area sealing means disposed in a downstream direction from the unwinding means for sealing at least part of the area of the two paper webs brought together to the two air-cushion sheet webs introduced between said paper webs, said webs being free of longitudinal folds;

three longitudinal sealing means and one transverse sealing means for sealing an edge region of each mailing bag being produced, including:

a central longitudinal sealing means for longitudinally sealing the center of the webs together to form a closed bag end with pockets on each side of the central seal; and outer edge longitudinal sealing means at each of two outer edges for sealing paper webs to air-cushion sheet webs without sealing the pocket openings;

said longitudinal and transverse sealing means disposed downstream of the area sealing means;

a traction means for transporting the paper sealed to the air-cushion sheet, said traction means disposed downstream of the transverse and longitudinal sealing means;

means for cutting the mailing bags to an intended format, said cutting means disposed downstream of the traction means;

triggering means for the production of the mailing bags;

a web run control means for correcting any incorrect running of the two connected paper webs disposed upstream of the cutting means;

cooling means following each of the longitudinal and transverse sealing means, the web run control means comprising, in the edge region of the sealed paper web in each case, a driveless guide roller inclined outwardly in the downstream direction and an associated driveless pressure roller outwardly inclined in the downstream direction, the pressure roller engaging an other opposite edge of the paper web only when the paper web runs out and the pressure duration of the pressure roller being adjustable by a timing member;

photocell means for determination of an incorrect running of the paper web at each edge; and an electronically controlled compressed air cylinder means for application of the pressure roller, in response to signals from the photocell means of the opposite edge; and a PTFE lance means for preventing a sealing of the pocket openings, said PTFE means provided in a region of pocket openings, in the running direction of the paper webs on the edge side, provided between the two air-cushion sheet webs during longitudinal sealing;

in the longitudinal sealing of the paper webs, for each longitudinal sealing means, adjustable coilable PTFE web means, which is secured to its respective longitudinal sealing element and extends over an area to be sealed, said web means for preventing soiling or sticking;

a cut length setting means and a setting means for mailing bag formats provided, the format setting means having racks in the running direction and transversely of the running direction of the paper webs and the racks meshing with adjusting pinions mounted on sealing elements of the sealing means and cooling elements of the cooling means;

for the transverse cutting of the mailing bags, a photocell control for defining the cut;

pulling rollers means for the transport of the paper webs sealed to the air-cushion sheet webs, said pulling roller means engaging on a longitudinal seal seam made within the paper web and on the lateral edges of the paper web;

having in the running direction of the paper webs before the web run control means, a punching means for producing flap closure holes and for bevelling the closure flaps, said means comprising: racks, and pinions meshing therewith and actuatable for adjustment.

14. Apparatus for the side by side manufacture of air-cushion mailing bags, each bag comprising a pair of inner air-cushion sheets facing each other, a pair of paper sheets disposed on the outer faces of said bag and facing the inner air cushion sheets with which they are substantially coterminous, said apparatus comprising:

paper unwinding means for unwinding two separate paper webs for disposing the same in juxtaposed facing relation along parallel paths;

air-cushion sheet unwinding means for unwinding two separate air-cushion sheet webs for disposing the same in juxtaposed facing relation along parallel paths between the paper webs;

area sealing means disposed in a downstream direction from the unwinding means for sealing at least part of the area of the two respective paper webs to the two respective air-cushion sheet webs introduced between said paper webs for reducing mutual tension between said paper webs and said sheet webs;

longitudinal central sealing means and transverse sealing means for sealing edge regions of adjacent mailing bags being produced;

said longitudinal and transverse sealing means disposed downstream of the area sealing means;

traction means for transporting the paper webs sealed to the air-cushion webs disposed downstream of the transverse and longitudinal sealing means;

longitudinal edge sealing means for sealing the outer edges of the upper paper web to the juxtaposed outer edge of the upper sheet web and the outer edge of the lower paper web to the juxtaposed outer edge of the lower sheet web;

lance means preventing sealing between the outer edges of the juxtaposed upper and lower sheet webs;

means for cutting the mailing bags to an intended format, said cutting means disposed downstream of said traction means; and triggering means for operating said sealing means.

* * * * *